United States Patent [19]

McCorquodale

[11] 4,333,529

[45] Jun. 8, 1982

[54] OIL RECOVERY PROCESS

[75] Inventor: Robert P. McCorquodale, West Hill, Canada

[73] Assignee: WetCom Engineering Ltd., Scarborough, Canada

[21] Appl. No.: 182,572

[22] Filed: Aug. 29, 1980

[30] Foreign Application Priority Data

Aug. 31, 1979 [GB] United Kingdom ..... 7930336

[51] Int. Cl.[3] ..... E21B 43/24; E21B 43/40

[52] U.S. Cl. ..... 166/267; 166/266; 166/272

[58] Field of Search ..... 166/265, 266, 267, 272, 166/303; 210/758, 761

[56] References Cited

U.S. PATENT DOCUMENTS

| | | | |
|---|---|---|---|
| 2,824,058 | 2/1958 | Zimmermann | 210/761 |
| 3,245,466 | 4/1966 | Hitzman | 166/266 |
| 3,772,181 | 11/1973 | Cole et al. | 210/761 |
| 3,881,550 | 5/1975 | Barry | 166/266 X |
| 4,007,786 | 2/1977 | Schlinger | 166/266 |
| 4,014,661 | 3/1977 | Hess et al. | 210/761 X |
| 4,100,730 | 7/1978 | Pradt | 210/761 |

OTHER PUBLICATIONS

Havlena, Z. G., "Some Innovative Approaches Which May Facilitate Production of Heavy Crudes", First International Conference on the Future of Heavy Crude and Tar Sands, Jun. 4–12, 1979, pp. 5–7.

*Primary Examiner*—Stephen J. Novosad
*Assistant Examiner*—George A. Suchfield
*Attorney, Agent, or Firm*—Sim & McBurney

[57] ABSTRACT

Oil recovery from formations is effected using a gas stream containing steam, carbon dioxide and nitrogen which is injected into the formation to form a water-oil mixture which is removed from the formation. The gas stream is formed by wet oxidation of a carbonaceous material which includes residual oil in the aqueous material remaining from oil separation.

7 Claims, 1 Drawing Figure

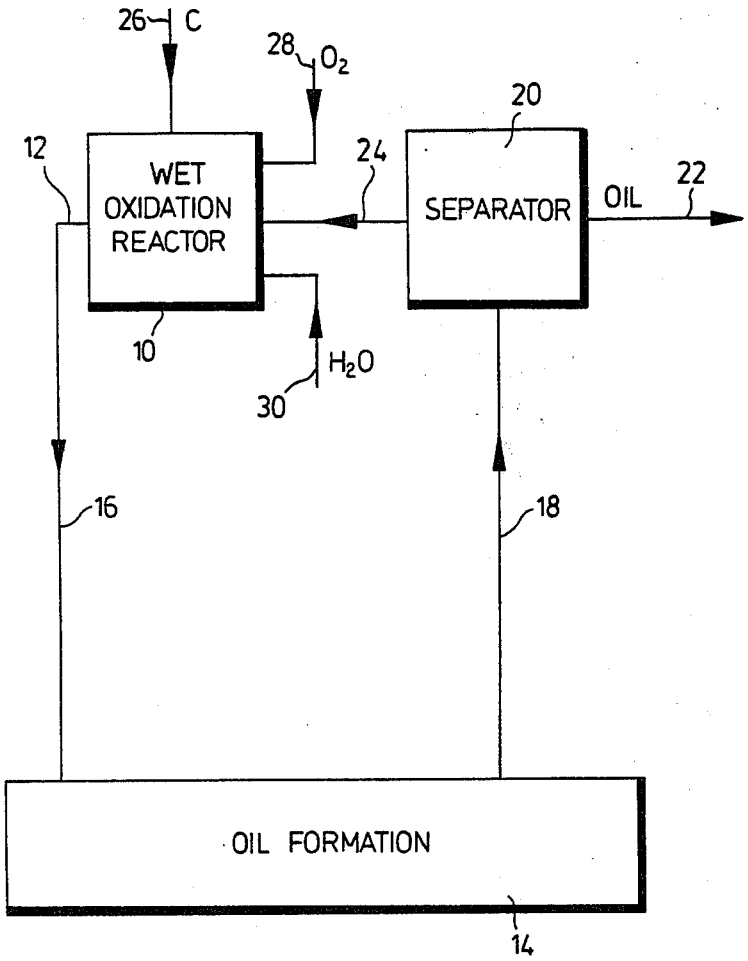
26
C
28
$O_2$
20
12
WET
OXIDATION
REACTOR
24
SEPARATOR
OIL
22
10
$H_2O$
30
16
18
OIL FORMATION
14

OIL RECOVERY PROCESS

FIELD OF THE INVENTION

The present invention relates to the recovery of oil from formations containing the same.

BACKGROUND TO THE INVENTION

Many conventional oil wells have been abandoned even though large quantities of extractable oil remain, as a result of the relatively high cost of known enhanced oil recovery techniques. In addition, there exist, throughout the world, large deposits of heavy and bituminous oils from which recovery is difficult and expensive.

Proposals have been made to recover bitumen from oil sand deposits and heavy oil deposits occurring in the Athabasca region of Alberta, Canada by the utilization of steam to render the bitumen flowable and the removal of the bitumen from the deposit in suspension in hot water under the influence of steam pressure. After separation of the bitumen from the aqueous phase, there remains an aqueous medium which is contaminated with residual hydrocarbons and minerals.

The contaminants inhibit the reutilization of this water for steam production, since the minerals scale reboiler tubes and the hydrocarbons cause fouling of boiler parts. Substantial volumes of water are required for the steam extraction procedure and the inability to utilize the aqueous medium imposes a considerable strain on the limited water resources of the region and also poses a considerable disposal problem.

SUMMARY OF THE INVENTION

The present invention is concerned with an oil recovery technique which can be used both as an enhanced oil recovery procedure on conventional oil deposits and also for the recovery of oil from heavy and bituminous oil deposits, such as, heavy crude deposits, and tar sands, while at the same time reutilizing waste water from the oil separation.

BRIEF DESCRIPTION OF DRAWING

The sole FIGURE of the accompanying drawing is a schematic flow sheet of one embodiment of the invention.

GENERAL DESCRIPTION OF INVENTION

In the present invention, there is formed a gaseous product stream having a pressure of about 500 to about 3000 psi, a temperature of about 200° to about 350° C. and a chemical content of:

about 50 to about 95% by volume $H_2O$
about 5 to about 50% by volume $CO_2$
0 to about 35% by volume $N_2$ The preferred product gas stream has a pressure of about 1500 to about 2500 psi, a temperature of about 275° to about 325° C. and a chemical constitution of about 70% by volume of $H_2O$, about 10% by volume of $CO_2$ and about 20% by volume of nitrogen.

Such a product gas stream is formed by wet oxidation combustion of carbonaceous material, as described in more detail below.

The pressure of the gas stream may be sufficient to enable the stream to eject oil from conventional deposits and the temperature combined with the pressure of the stream may be sufficient to cause heavy crude oils and bituminous oils to flow and to be ejected from deposits, depending on the location of the deposit and the pressure and temperature of the gas stream. When the pressure and/or temperature of the gas stream is insufficient to achieve the desired ejection, then these parameters may be increased by pumps and/or heat.

While the product gas stream more usually is used in conjunction with the recovery of oil from subterranean deposits, the product gas stream may also be used in the recovery of oil from surficial deposits or from oil-bearing mined material, such as, bituminous oil sands and oil-bearing shales.

The wet oxidation combustion of the carbonaceous material to form the product gas stream is effected by contacting an aqueous dispersion of the carbonaceous material with an oxidizing gas in a closed vessel at sufficient temperature and pressure for sufficient time to effect substantial oxidation of the carbonaceous material to form steam and carbon dioxide.

In order to produce a product stream of the above-recited chemical content and at the temperature and pressure noted above, the wet oxidation combustion is effected at a temperature of about 200° to about 350° C., preferably about 275° C. to about 325° C., and at a pressure of about 500 to about 3000 psi, preferably about 1500 to about 2500 psi.

The reaction time depends on the quantities of material combusted, and is usually from about 5 to about 120 minutes, preferably about 20 to about 60 minutes.

The oxygen source for the wet oxidation combustion usually is air, although pure oxygen or a mixture of air and pure oxygen may be used. When air is used, the product gas stream contains nitrogen and the utilization of steam, carbon dioxide and nitrogen mixtures in oil recovery is unique.

The quantities of carbon and oxygen are correlated to achieve substantially complete combustion of the carbonaceous material. Usually, a small excess of oxygen is used to ensure such complete combustion. The carbonaceous material source is comprised, at least in part, by an aqueous carbonaceous material-containing waste stream, which is the waste stream remaining from the separation of oil from an oil-water mixture removed from a subterranean formation as described above.

In such waste streams, the concentration of carbonaceous material is quite low, usually from about 1000 to about 10,000 ppm COD, so that in order to generate the required pressure in the product gas stream, additional carbonaceous material is added, to provide an overall carbonaceous material concentration of up to 26 wt.% as COD, usually in the range of about 10 to about 20 wt.% as COD.

The additional carbonaceous material may be any convenient combustible material. When the product gas stream is used to recover heavy or bituminous oil from a subterranean formation, the carbonaceous material may be by-products from the upgrading of such materials, such as, coke or oil residua. Other materials, such as, coal, peat and lignite may be used.

The ability to use such a waste stream directly for steam regeneration, as is the case in this invention, has substantial benefits and represents a considerable advance in the art. Some make-up water is required but the substantial water requirements of the prior art are eliminated and the carbon impurity content of the waste stream is utilized.

DESCRIPTION OF PREFERRED EMBODIMENT

Reference is made to the accompanying drawing, which is a schematic flow sheet of one embodiment of a procedure for the recovery of oil in accordance with the present invention. A wet oxidation reactor 10 is fed with a variety of streams, described in more detail below, and effects wet combustion of carbonaceous material to form a high pressure and temperature stream of steam, carbon dioxide and nitrogen in line 12 which is injected into an oil formation 14 through well bore 16, with pressure and/or temperature enhancement, if required.

Heavy and bituminous oils, with or without associated mineral matter, are usually non-flowable. The injected steam and/or hot water serve to heat and decrease the viscosity of the heavy or bituminous oil in the formation 14 while the carbon dioxide mixes with the oil to render the same flowable. The pressure of injection of the vapor stream through the well bore 16 forces the flowable oil in admixture with water out of the formation 14 through a producing well bore 18.

Where the oil formation 14 is a conventional deposit, less pressure is required to eject the oil from the formation 14 through the producing well 18, since the oil is already in the flowable condition. Where the oil formation 14 is a bituminous oil formation having a large proportion of mineral material associated therewith, such as, an oil sand or oil shale, the mineral phase may be left in the formation or may be removed with the oil-water mixture and separated at the surface.

The mixture of water and oil passing out of the producing well bore 18 passes to a water-oil separator 20 wherein the oil phase and water phase are separated by any convenient procedure, such as, gravity separation. The separated oil is forwarded by line 22 to upgrading, if required.

The aqueous phase remaining from the oil-water separation contains a residual concentration of oil, usually in a concentration of about 1000 to about 10,000 ppm, and is forwarded by line 24 to the wet oxidation reactor 10, wherein the residual oil is combusted, along with additional carbon source material fed by line 26, in oxygen fed as such or as air by line 28. Make up water is fed by line 30.

The oil recovery process shown in the drawing and as just described, therefore, enables heavy or bituminous oils to be recovered from subterranean formations by the application of heat and pressure while the waste stream conventionally associated with such procedures is eliminated, since such stream is reused directly for further stream formation. The overall water requirements are substantially decreased.

Heavy and bituminous oils and their by-products, such as, coke, usually contain high proportions of sulphur. Under the conditions which exist within the reactor 10, any sulphur which is present in the carbonaceous material which is combusted therein is oxidized and remains in the aqueous phase as sulphuric acid, so that the combustion process which is effected in the reactor 10 is not attended by air pollution problems, such as, sulphur dioxide. The sulphuric acid may be recovered as a by-product, or used elsewhere in the recovery process. The process of the invention, therefore, is capable of using low grade fuels in an air-pollution-free manner.

EXAMPLE

Vacuum tank bottoms from the upgrading of bitumen recovered from a tar sands formation was combusted in an enclosed reactor in an aqueous dispersion in air injected into the reactor.

Experiments were conducted both in the presence and absence of oxidation-enhancing copper catalyst for 60 minutes under differing conditions and the degree of combustion of the carbonaceous material was determined.

The results are reproduced in the following Table:

TABLE

| Condition | | Degree of Combustion % of Total | |
|---|---|---|---|
| T° C. | Pressure psi | No. Cat. | Cu Cat. |
| 225° | 650 | 30 | 80 |
| 250° | 750 | 85 | 90 |

The results of the above Table show that substantially complete combustion of the bitumen upgrade by-product can be effected.

SUMMARY OF DISCLOSURE

In summary of this disclosure, the present invention provides a unique oil recovery process in which by-product streams previously considered to be waste streams are reutilized in a controlled process. Modifications are possible within the scope of this invention.

What I claim is:

1. A continuous process for the recovery of oil from an oil deposit, which comprises:

(a) continuously feeding an aqueous dispersion of carbonaceous material having a concentration of about 10 to about 20 wt.% COD to an enclosed reaction zone, (b) continuously contacting said aqueous dispersion of carbonaceous material with an oxidizing gas in said enclosed reaction zone at a temperature of about 200° to about 350°, at a pressure of about 500 to about 3000 psi and for a time of about 5 to about 120 minutes to effect substantial wet oxidation combustion of said carbonaceous material to form a product gas stream having a pressure of about 500 to about 3000 psi and containing about 50 to about 95% by volume of steam, about 5 to about 50% by volume of carbon dioxide and 0 to about 35% by weight of nitrogen, (c) continuously injecting said product gas stream into said oil deposit under sufficient pressure to cause said oil to be ejected from said deposit in aqueous admixture, (d) continuously recovering oil from said ejected aqueous admixture to leave an aqueous medium containing residual quantities of said oil in a concentration of about 1000 to about 10,000 ppm COD, (e) continuously adding to said aqueous medium sufficient quantity of a fossil fuel to provide an aqueous dispersion of carbonaceous material having a concentration of about 10 to about 20 wt.% COD, and (f) continuously forwarding said latter aqueous dispersion to said enclosed reaction zone as said continuously fed aqueous dispersion in step (a), whereby said residual quantities of said oil are consumed in forming said gas stream.

2. The process of claim 1 wherein said oil deposit is a conventional subterranean oil deposit in which the oil readily flows upon the application of pressure supplied at least in part by said product gas stream thereto.

3. The process of claim 1 wherein said oil deposit is a subterranean heavy crude oil and said product gas stream possesses sufficient enthalpy to decrease the viscosity of said heavy crude oil in said deposit sufficient to enable the same to flow under pressure supplied at least in part by said product gas stream.

4. The process of claim 1 wherein said oil deposit is a bituminous oil sand and said product gas stream possesses sufficient enthalpy to decrease the viscosity of said bituminous oil in said oil sand sufficient to enable the same to flow under pressure supplied at least in part by said product gas stream.

5. The process of claim 1 wherein said temperature is about 275° to about 325° C., said pressure is about 1500 to about 2500 psi and said time is about 20 to about 60 minutes.

6. The process of claim 1 wherein said fossil fuel-based carbonaceous material is selected from the group consisting of oil recovered from the formation, a by-product from upgrading of such oil, coke, coal, peat and lignite.

7. The process of claim 1 wherein said oxidizing gas is air, whereby said product gas stream contains steam, carbon dioxide and nitrogen.

* * * * *